United States Patent [19]

DeLigt

[11] 4,038,917

[45] Aug. 2, 1977

[54] THIN BELT EMBOSSING METHOD AND APPARATUS

[75] Inventor: John DeLigt, Covington, Va.

[73] Assignee: Westvaco Corporation, New York, N.Y.

[21] Appl. No.: 685,104

[22] Filed: May 10, 1976

Related U.S. Application Data

[63] Continuation-in-part of Ser. No. 272,733, July 18, 1972, abandoned, and a continuation-in-part of Ser. No. 750,659, Aug. 6, 1968, abandoned.

[51] Int. Cl.[2] ..... B44B 5/00

[52] U.S. Cl. ..... 101/23; 101/32; 74/242.8; 100/173; 226/7; 226/97

[58] Field of Search ..... 101/32, 23; 26/101, 26/87; 226/7, 97, 196–199, 170–172; 162/197, 271; 425/385, 373; 74/242.8; 100/155, 176, 173, 174, 175

[56] References Cited

U.S. PATENT DOCUMENTS

| | | | |
|---|---|---|---|
| 389,949 | 9/1888 | Baker | 101/23 |
| 1,630,713 | 5/1927 | Meyer | 226/97 |
| 1,638,560 | 8/1927 | Beveridge | 26/87 X |
| 1,700,099 | 1/1929 | Shively | 226/199 |
| 2,560,038 | 7/1951 | Trainer | 26/101 X |
| 3,053,425 | 9/1962 | Baines | 226/7 X |
| 3,247,785 | 4/1966 | Shultz | 101/23 |
| 3,460,194 | 8/1969 | Thompson | 26/87 |

*Primary Examiner*—Clifford D. Crowder
*Attorney, Agent, or Firm*—W. Allen Marcontell; Richard L. Schmalz

[57] ABSTRACT

Uniform embossing on both sides of a web of paper may be obtained in a single pass through an embossing nip by interposing a thin film of tough, resilient material in the form of a continuous belt of approximately 0.050 inch thickness or less between the embossing roll and the backup roll. Stationary guide members, which may be combined with air bearings, are provided to insure proper tracking of the belt.

18 Claims, 11 Drawing Figures

THIN BELT EMBOSSING METHOD AND APPARATUS

CROSS REFERENCE TO RELATED APPLICATIONS

This application is a Continuation-In-Part of my earlier copending application Ser. No. 272,733 filed on July 18, 1972, said copending application being a Continuation-In-Part of my application Ser. No. 750,659 filed AUG. 6, 1968, both now abandoned.

BACKGROUND OF THE INVENTION

1. Field Of The Invention

Embossing with a rolling contact machine using a rotary die.

2. Description Of The Prior Art

In most embossing operations, it is desirable that the material being treated receives a pattern of uniform depth and quality of both sides. Heretofore, this desiderata has been obtained by either utilizing mating male and female dies or running the material twice through an embossing machine comprising either an engraved embossing roll and a resilient backup roll or an engraved embossing roll bearing against a resilient blanket or belt supported by a hard surfaced backup roll. For a more complete discussion and example of prior art embossing machinery reference is made to U.S. Pat. Nos. 389,949; 2,611,312; and 3,247,785. The first of these, U.S. Pat. No. 389,949 to J. M. Baker, shows an embossing machine wherein the engraved embossing roll bears against an elastic belt of soft rubber supported by a backup roll. With this type of construction, it is believed, in order to obtain uniform embossing on both sides of the web, it is necessary to direct the web through the embossing nip in at least two passes.

In U.S. Pat. No. 2,611,312 uniform embossing on both sides of the web is obtained by running the web through a calender stack having two engraved embossing rolls. Of course, a machine of this type, would be quite expensive and cumbersome and not suited for many installations.

U.S. Pat. No. 3,237,785 to R. S. Shultz, utilizes a thin resilient covering of 1/32 inch on a hard surface backing roll. As an embossing technique for aluminum foil, the Shultz disclosure may be considered successful since sharp relief may be transferred to both sides of the web in a single pass. However, aluminum requires only 2% of the nip pressures required by paper. Under the moderate to high nip pressures required for double face paper embossing, the thin, resilient backing layer 56 experiences stress distortion of such magnitude that it is extremely difficult, if not impossible, to hold the backing layer tightly and smoothly against the backing roll 47. Consequently, as a commercial method for embossing paper, the Shultz apparatus is unacceptable. Although numerous valcanizing and bonding techniques have been attempted, no successful method has been found to prevent the thin backing layer 56 of Shultz from distorting beyond the yield limit of such bonds. In a relatively short interim at 600 pounds per lineal inch (pli) nip pressure operating on paper, a backing layer of the type and dimension described by Shultz will be torn from the steel backing roll 56.

SUMMARY

The present invention permits uniform embossing on both sides of a web to be obtained in one pass through the embossing nip using moderate nip pressures by interposing a thin film of resilient material in a form of continuous belt between the web being embossed and the backup roll. Since diligent attempts to secure a thin, resilient backing film to a hard surface backing roll have proven impractical, success has been won from the opposite tack; by releasing the film from as much restraint as possible. The elements of such success comprise the mere draping of a thin, resilient film, backing belt around a circuit of effective diameter substantially greater than that of the backing roll and simultaneously keeping the prenip rollup of extrusively distorted belt material from growing to such proportions as to have a loop or wrinkle thereof destructively drawn into the nip.

Although no special tracking precautions are necessary with such thin film embossing systems comprising polyurethane belts of Shore "A" 95 durometer hardness and less than 1000:1 width to thickness ratio traveling at 10 fps surface velocity into a 600 pli embossing nip at standard atmospheric operating conditions with less than 2° of wrap about the backing roll on the nip approach, systems imposing stress distortion conditions in excess of the foregoing must be provided with devices to keep the thin film tension immediately antecedent to the embossing nip within reasonable limits across the belt width.

Gear driven turning rolls of the type described by Baker have been found completely inadequate for such cross-machine direction (CD) tension profile management of thin film embossing belts. Consequently, the present invention provides stationary, fluid bearing means at machine direction (MD) turning points for dual functional purposes including CD tension management.

Also disclosed herein is the finding of a maximum thickness for a thin embossing belt of approximately 0.05 inch for quality, double face embossing with quality improvement gained as the thickness diminishes. An embossing belt thickness of approximately 0.02 inch has optimum operational characteristics on 0.0055 caliper, 60–80 lbs./ream paper for a 3000:1 w/t ratio, polyurethane belt of Shore "A" 95 hardness entering a 1000 pli embossing nip at 17 fps surface velocity.

DESCRIPTION OF THE PREFERRED EMBODIMENTS

Figure 1:
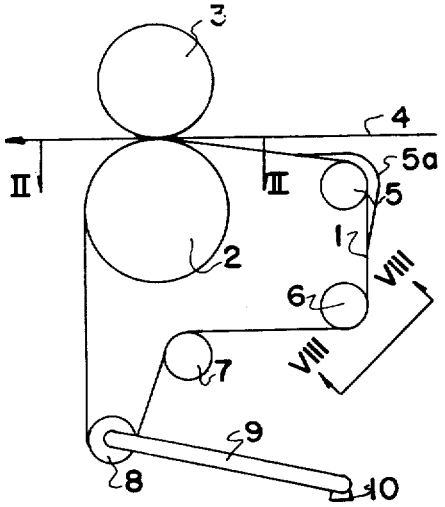
FIG. 1 is a side elevational schematic of one preferred embodiment of the invention.

With reference to FIG. 1 of the drawings, it will be seen that in one embodiment of the present invention a thin film of resilient material in the form of an endless belt 1 is trained around a backup roller 2 forming a nip with an engraved embossing roller 3. A web of paper or the like 4 passes through the nip from right to left as seen in FIG. 1. A plurality of stationary, belt direction turning member 5, 6, and 7 may be provided to assure proper tracking of the belt as it courses a closed circuit about the nip. Additionally, a take up device may be utilized which consists simply of a stationary bar 8 mounted on one end of an arm 9 which may be pivoted, as at 10, so that its weight tends to take up any slack in the system. It will also be noted that turning member 5 is bowed, as at 5*a*, in a direction away from the embossing nip to spread the belt 1 and assure smooth and substantially uniform tension across the width thereof as it enters the embossing nip. Such assurances are necessitated by and provided for the reasons to follow.

Figure 9:
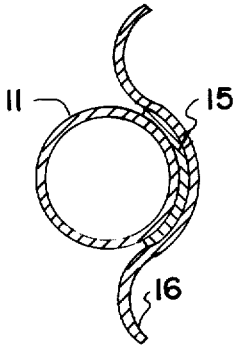
FIG. 9 is a sectional view of the belt edge guide and lateral control device of the FIG. 8 apparatus seen from viewing plane IX—IX.
Figure 10:
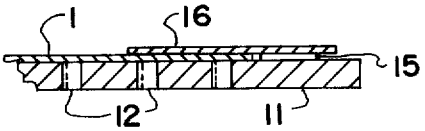
FIG. 10 is the same device shown by FIG. 9 but as viewed from plane X—X.
Figure 8:
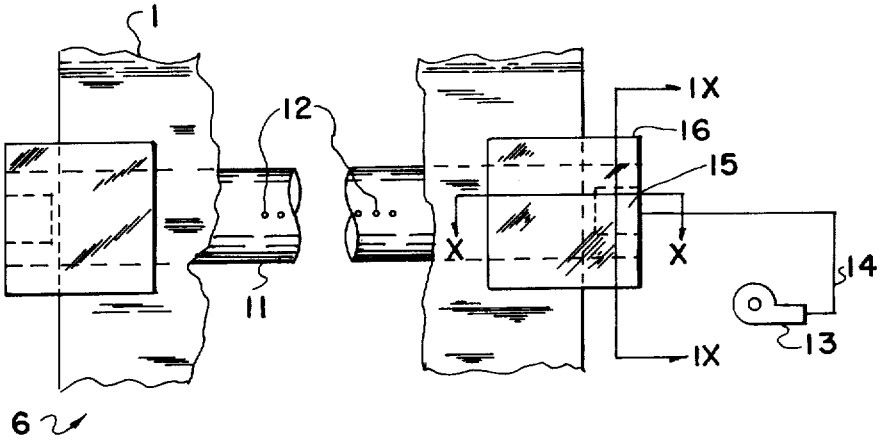
FIG. 8 is an enlargement of the belt circuit turning apparatus seen from viewing plane VIII—VIII of FIG. 1.

Other structural incidents of the preferred embodiment may include additional turning members 6 and 7. Except for the bowed configuration of member 5, all turning members are of similar construction as illustrated in FIGS. 8 through 10 and comprise a pipe member 11 having a series of apertures 12 therein. The interior volume of pipe 11 is supplied by pump 13 through the line 14 with a constant flow of air to form an air bearing for the belt 1. A small metal pad 15 is attached to the pipe 11, as by welding or the like, and serves to support a flange member 16 in spaced relation to the surface of the pipe. In this way, if the thin belt 1 tends to become untracked through distortions experienced in the embossing nip, the flange members 16 and pads 15 will exert a restoring force on the web and prevent loss of tracking.

As noted previously, it is essential that the belt 1 be in the form of a thin resilient film if dual embossing with one pass through the embossing nip is to be obtained. While experience has indicated that the thinner the film the more pronounced the embossing, an upper limit of approximtely 0.050 inch appears to be the maximum that can be utilized as practical matter to obtain acceptable embossing. In an actual installation, satisfactory results have been obtained in standard atmospheric operating environment by using belts formed of a polyurethane film having approximately 95 Shore "A" hardness with a range of thicknesses of 0.010 to 0.025 inch running at 10 fps surface velocity over an unsupported span of 12 in. into a nip pressure of 600 to 800 lbs. per linear inch.

Figure 4:
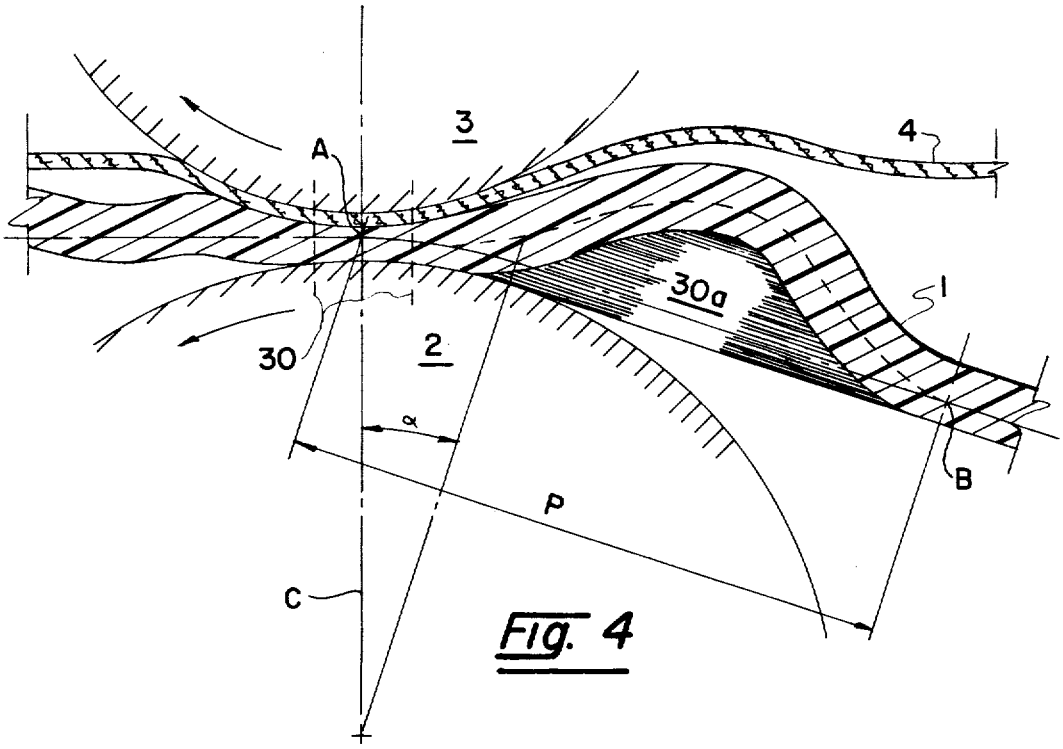
FIG. 4 is an enlarged, sectionl elevation at the machine cross-direction midspan viewed from cutting plane IV—IV of FIG. 2 showing one condition of a standing wave in the embossing belt before the nip.

No particular difficulty is encountered from operating the above described belt 1 in a conventional manner if the width to thickness ratio (w/t:) of the belt is less than 1000:1. However, when w/t exceeds 1000:1, other conditions remaining the same, the effect of a standing wave in the belt mid-portion, as best seen from FIG. 4, starts to approach criticality. Although the following description of the mechanics of criticality are largely a matter of conjecture, the premises thereof are supported by experience.

Figure 2:
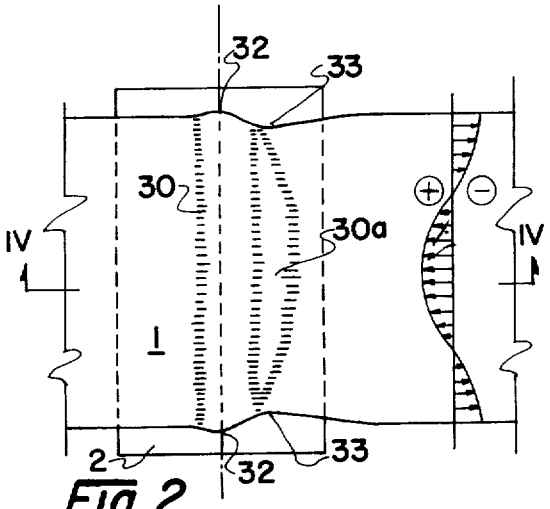
FIG. 2 is a plan of the backing roll side of the nip viewed from cutting plane II—II of FIG. 1 showing an exaggerated distortion of the embossing belt under one state of belt tension distribution.

Relative first to FIG. 2, compressive stress within the nip has the effect of extrusively distorting the belt shape and thickness within the region 30. Since the belt material is essentially incompressible, the stressed portion thereof is merely displaced thereby causing bulges 32 at the web edges and transversely therebetween. Extruded material along the lateral edges of the belt is free to flow laterally. However, the belt central portions must be displaced along the machine running direction. On the approach side of the nip, where the total flow of the belt material is toward the nip line, a countercurrent flow of belt material occurs to create a region of compressive stress ⊕ as represented by the stress profile diagram superimposed on the FIG. 2 belt section. The bounded area on the $\theta$ side of the diagram represents the distribution of tensile forces within the belt section.

To further complicate analysis, the belt 1 also exhibits tensile yielding characteristics as manifest by the necking tendency of the belt in regions 33. Since friction drive from the embossing nip provides motive power to the belt 1, tensile strain to overcome the belt inertial, frictional and gravitational resistance would be greatest in the region 33. Although such longitudinal yielding as the cause lateral edge necking is within proportional limits, it is conceivable that coincident lateral stress relative to the belt center axis further operates to create an excess of belt material in the region 30*a*. Said excess of material 30*a* is the substance of a standing wave in the belt course immediately ahead of the nip and is the cause of free running, embossing film belt failures. If the amplitude of said standing wave is not restrained to maximum critical limits, the entire wve will be drawn into the nip with the consequent ruination of the embossing pattern and destruction of the belt.

Figure 3:
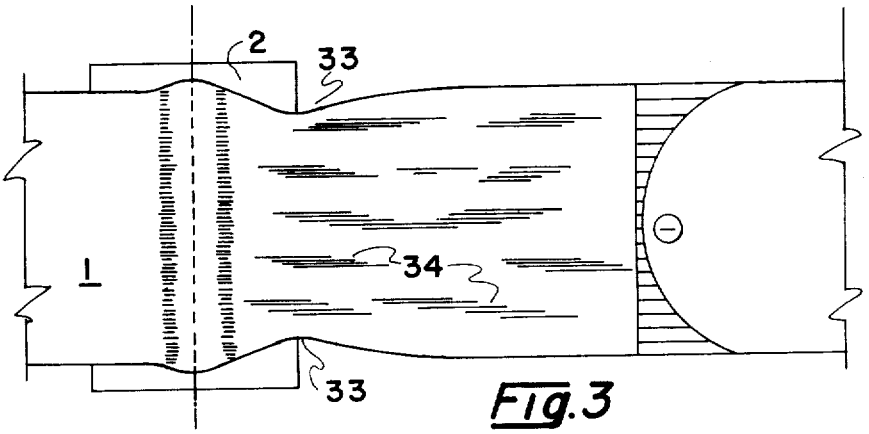
FIG. 3 is a plan of the backing roll side of the nip viewed from cutting plane II—II of FIG. 1 showing an exaggerated distortion of the embossing belt under another state of belt tension distribution.

Destruction may also occur from attempts to prevent standing wave accumulation by tensioning the belt 1 over the unsupported span so greatly as to assure the stress distribution profile of FIG. 3 where even the midsection of the belt has at least a small degree of tensile stress. Experience with belts of the present description having w/t greater than 1000 running over conventional cylindrical turning rolls indicates a tendency to develop severe necking in the regions 33 and longitudinal fluting 34 begins to appear. When drawn into the nip, such longitudinal flutes are equally destructive as the standing wave failures.

A complete analysis of such standing wave mechanics is extremely complicated due to the multiplicity of relevant parameters including; belt speed, average tension, nip pressure, belt width, belt thickness, unsupported span length, frictional coefficients of the backing roll surface and paper web surface, modulus of elasticity, hardness, poisson's ratio, temperature and humidity. In so far as such a complex dynamic system is susceptible of complete analysis by state-of-the-art analytical techniques, however, it is only necessary, for reliable continuing operation of such a system, to recognize the nature of the failure and deploy the present invention within narrow limits of experimentation obvious to those of ordinary skill in the art.

The first factor to be acknowledged in this empirical approach is the standing period P (FIG. 4) for the particular belt and running conditions. P is that distance, measured along the theoretical plane of the belt 1, from the theoretical nip point A between rollers 2 and 3, to a point B ahead of the nip where the actual plane of the belt 1 first crosses or coincides with the theoretical plane. The theoretical nip point a is equidistant between the surface elements of rolls 2 and 3 and within the plane of smallest separation between said surface elements. Nip point A is assumed to lie in the throat of the belt 1 constriction as it passes between rolls 2 and 3.

Plane C is defined as including both axes of rolls 2 and 3 and is characterized herein as the plane of tangency. Theoretical nip point a lies within plane C.

A theoretical plane that is parallel with the axes of rolls 2 and 3, perpendicular to the plane of tangency C and intersects said plane C at point A shall be characterized herein as the nip tangent.

Angle $\alpha$ is the included angle between the nip tangent and the linear portion of the theoretical belt plane from the turning member 5.

Angle $\alpha$ may also be considered as the circular arc, about the center of backup roller 2, between the point A and the first point of normal coincidence between the theoretical belt plane and a radii of backup roller 2.

Figure 5:
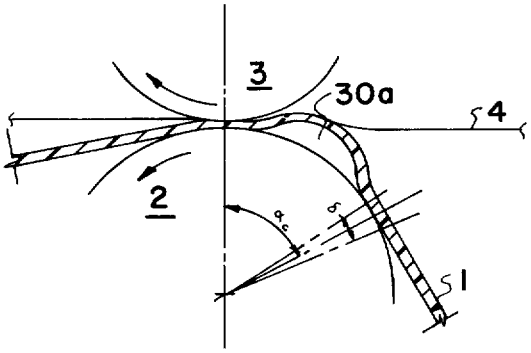
FIG. 5 is an abbreviation of FIG. 4 but under other standing wave conditions.
Figure 6:
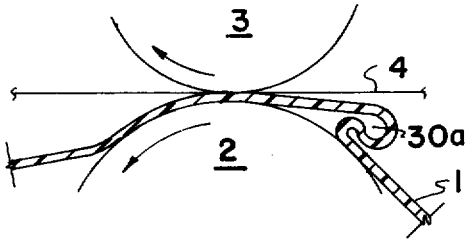
FIG. 6 is another abbreviation of FIG. 4 but showing a belt destructive standing wave condition.

It is not necessary to actually determine the period P in linear units but to merely recognize the substantive relationship between P and the average angle $\alpha$. As the angle $\alpha$ is increased, the belt 1 makes contact with the backing roll 2 along the periphery of region **30*a* remote from the nip. The critical angle $\alpha c$ is reached when the angle of belt wrap $\delta$ is seen from FIG. 5, is sufficient to frictionally seize the belt 1 over the arc of $\delta$ and draw it into the nip ahead of the standing wave loop 30*a* as shown in FIG. 6**.

Solution to the above described problem is won by sustaining sufficient longitudinal tension across the unsupported span of the belt 1 between the nip and the next previous turning member 5 so as to assure that the critical angle $\alpha c$ is not exceeded at any point thereacross.

Cooperative with maintenance of the above described tension is to arrange a low mean angle $\alpha$ relationship between the turning member 5 and the embossing nip. A smaller angle $\alpha$ requires less tensile exertion on the belt to keep the critical angle $\alpha c$ within tolerable limits.

Figure 7:
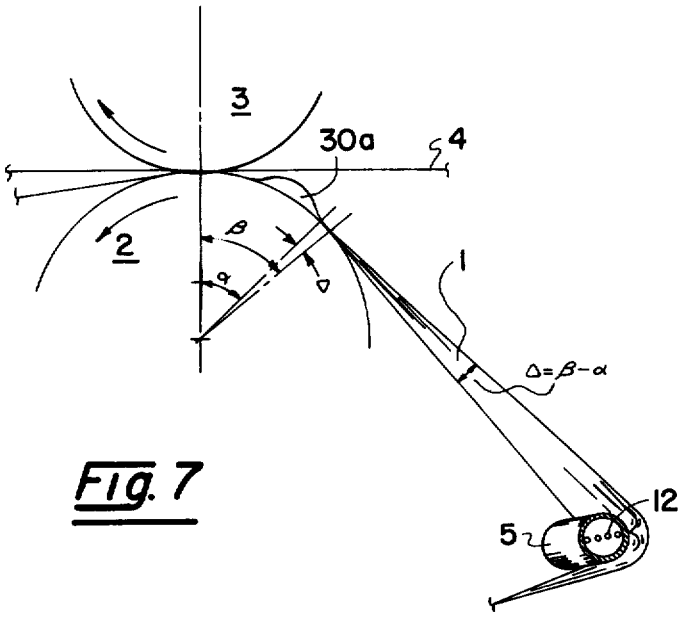
FIG. 7 is another abbreviation of FIG. 4 but showing the effect of the present invention on the belt standing wave.

Prior art techniques of tension management such as parallel axis turning rolls, cylindrical or crowned, are unsatisfactory for this puprose as having only fixed geometry for tensile distribution. In high w/t embossing film belts (wt greater than 1000) of the nature described herein, it is necessary to apply a smoothly distributed force, independent of position, to draw the standing wave period out from critical contact with the backing roll 2 as localized accumulations of material develop. For this purpose, the turning member 5, which is hollow and vented with apertures 12 as seen from FIG. 7, is also transversely bowed with the bight of the bow disposed to decrease the angle $\alpha$ of approach of the belt midsection reltative to the angle $\beta$ of approach of the belt lateral edges so as to provide an angular differential $\Delta$ between the belt midsection and edges respectively as they approach the nip. The magnitude of angle $\Delta$ is further increased by the discharge of pressurized fluid from the apertures 12.

Although the fluid bearing between the underside of belt 1 and the proximate surface elements of turning member 5 offer a relatively frictionless pivot station for the belt circuit, the more significant contribution of the fluid bearing is to provide, within tolerable limits, a uniformly distributed tensioning force across the belt width that is independent of fixed position. As the bearing space becomes larger coincident with a localized increase in the standing wave amplitude, the longitudinal belt tension remains constant to restrain the wave from further increasing.

To contrast this operation with a fixed geometry turning roll, as a localized standing wave before the nip grows, no localized compliance of the tensioning surface is available to attenuate the growth. To the contrary, the wave provides an effective decoupling of the nip tractor force to the belt length opposite from the wave. Accordingly, belt tension along the longitudinal elements including the wave diminishes. With the diminution of tension, the wave further increases in amplitude until the critical angle $\alpha$ is exceeded whereupon the entire wave is drawn into the nip to destruction.

Since belt tension and the angle $\alpha$ are so critically interrelated, it is obvious that the magnitude of tension necessary to control a standing wave may be minimized in the embossing machine design by reducing the angle $\alpha$ to a tolerable minimum. Ideally, the belt 1 should approach the nip tangentially. However, for the belt and operating conditions described above, an approach angle $\alpha$ of 10° has been found tolerable. Since the midsection bulge tends to reduce this angle by the magnitude of 1° ($\Delta$), the ideal angle of tangency is approached in that critical region.

Figure 11:
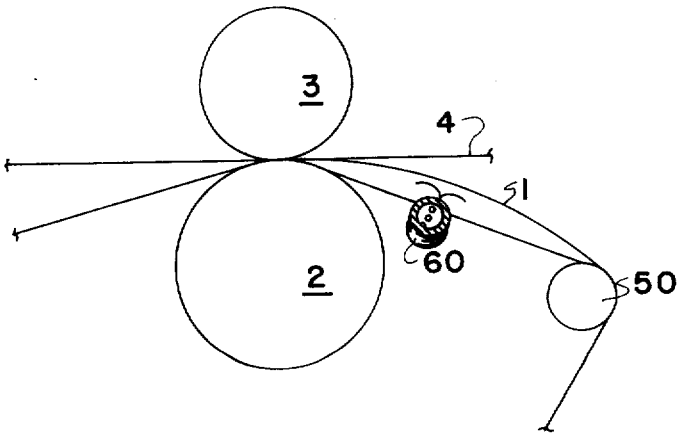
FIG. 11 is another embodiment of the invention.

The FIG. 11 embodiment of the invention illustrates an alternative approach to thin belt tension management suitable for incorporation with more conventional belt embossing machines. Turining roll 50 may be a fixed axis rotating cylinder as is known by the prior art. For tension control, air distribution manifold 60 is positioned transversely of the belt 1 between the roll 50 and the nip. Construction of the manifold 60 is similar to that of members 5 or 6 having either a straight or bowed axis. In either case, the objective of manifold 60 is to inflate the belt 1 between roll 50 and the nip to effect a gentle longitudinal tensioning of the belt 1 thereacross with a position compliant force.

While certain embodiments of the invention have been described for purposes of illustration, it will be apparent that modifications thereof will occur to those skilled in the art within the scope of the appended claims.

I claim:

1. An embossing machine comprising:

a. an engraved embossing roll;

b. a backup roll forming an embossing nip with said engraved embossing roll;

c. an endless belt of appreciably greater circumference than said backup roll, said endless belt comprising a thin film of elastomeric material having a thickness dimension not exceeding 0.050 inches wherein a portion of said belt overlies said backup roll in said embossing nip;

d. at least one stationary support member supporting said belt at a point spaced from said nip for maintaining the edges of said belt substantially parallel to the edges of said backup roll;

e. flange means extending from said stationary support member and overlying portions of said belt adjacent the edges thereof;

f. at least one hollow tubular guide member underlying a portion of said belt;

g. means forming a series of apertures in said tubular member along the length thereof, said apertures being arranged along a portion of the surface of said hollow tubular member which is directed toward the surface of said belt; and h. means for supplying said under pressure to the interior of said hollow tubular member.

2. The apparatus of claim 1 wherein at least one hollow tubular member is located immediately upstream of said embossing nip and bowed in a direction substantially away from said embossing nip.

3. An embossing machine comprising:

a. an engraved embossing roll;

b. a backup roll forming an embossing nip with said engraved embossing roll;

c. an endless resilient belt having a width to thickness ratio of greater than 1000:1 and an appreciably greater periphery than the circumference of said backup roll, said belt being disposed for traveling about closed course passing through said nip; and d. belt tensioning means for applying substantially uniform longitudinal tensile stress to and across substantially the entire width of said belt from said nip regardless of reasonable dimensional variations in the proximity between said belt and fixed position structure of said tension means, said fixed position structure comprising a fluid conduit transversely disposed across said course and antecedently proximate of said nip, said conduit having fluid discharge apertures oriented to direct fluid flow against one face of said belt.

4. The apparatus of claim 3 comprising a direction change station in said belt course proximate of a plane including said nip that is perpendicular to the plane of tangency between said embossing and backup roll.

5. The apparatus of claim 4 wherein said direction change station comprises said belt tensioning means.

6. The apparatus of claim 5 wherein said fixed position structure of said belt tensioning means is axially bowed transversely of said belt.

7. The apparatus of claim 4 wherein said belt tensioning means is disposed between said direction change station and said nip.

8. An embossing machine comprising:

a. an engraved embossing roll;

b. a backup roll forming an embossing nip with said engraved embossing roll;

c. an endless belt of elastomeric material having a thickness dimension not exceeding 0.050 inches, a width to thickness ratio of greater than 1000:1 and a periphery that is appreciably greater than the circumference of said backup roll, said endless belt being disposed for traveling about a closed course passing through said nip; and d. belt tensioning means for applying substantially uniform longitudinal tensile stress to and across substantially the entire width of said belt from said nip regardless of reasonable dimensional variations in the proximity between said belt and fixed position structure of said tension means, said fixed position structure comprising a fluid conduit transversely disposed across said course and antecedently proximate of said nip, said conduit having fluid discharge apertures oriented to direct fluid flow against one face of said belt.

9. The apparatus of claim 8 wherein said endless belt is of approximately 95 Shore "A" hardness.

10. The apparatus of claim 8 comprising a direction change station in said closed course proximate of a plane including said nip that is perpendicular to the plane of tangency between said embossing and backup rolls.

11. The apparatus of claim 10 wherein said direction change station comprises fluid pressure means.

12. The apparatus of claim 11 wherein said belt tensioning means comprises said direction change station.

13. A method of simultaneously embossing opposite surfaces of an emboss material having a density of 60 pounds per ream or greater in a single pass through an embossing nip comprising an engraved embossing roll and a smooth surface backup roll, said method comprising the steps of:

A. Providing an endless belt of elastomeric material having a thickness dimension not exceeding 0.050 inches, a width to thickness ratio of greater than 1000:1 and a periphery that is appreciably greater than the circumference of said backup roll;

B. Guiding said endless belt in a traveling direction through said nip and around said backup roll;

C. Drawing a web of said emboss material through said nip between said endless belt and said engraved roll;

D. Loading said nip to compress said web between said endless belt and said engraved roll with a pressure of at least 600 pounds per lineal inch of nip; and, E. Maintaining a substantially uniform longitudinal tensile stress to and across substantially the entire width of said belt from said nip within a longitudinal increment of said belt extending from said nip in a direction opposite from said traveling direction.

14. A method as described by claim 13 wherein said belt is guided in a plane on a material in-flowing side of said nip that approaches a plane including both rotational axes of said rolls at an angle not substantially greater than 10°.

15. A method as described by claim 13 wherein the entire width of said belt is restrained from contacting the surface of said backup roll on a material in-flowing side of said nip at a point substantially greater than 10° about a rotational axis of said backup roll from a radial reference passing through a rotational axis of said engraved roll.

16. A method as described by claim 13 wherein a substantially uniform fluid pressure is maintained against substantially the entire width of a surface of said belt opposite from said web in the near proximity of said nip on a material in-flowing side thereof.

17. A machine for embossing a paper web material having a density of 60 pounds per ream or greater, said machine comprising:

A. An engraved embossing roll;

B. A backup roll forming an embossing nip with said embossing roll;

C. An endless resilient belt of no greater than 0.050 inch thickness, a width to thickness ratio of greater than 1000:1 , approximately 95 Shore "A" hardness and appreciably greater periphery than the circumference of said backup roll, said belt being disposed for traveling about a closed periphery passing through said nip;

D. Means for continuously drawing said belt in a longitudinal traveling direction through said nip with said web material disposed between said embossing roll and one face of said belt; and E. Means for maintaining a substantially uniform longitudinal tensile stress in said belt across substantially the full width thereof along a longitudinal increment of said periphery when said belt is being drawn through said nip and said nip is loaded with at least 600 pounds of force per lineal inch of nip, said longitudinal increment extending from said nip in a direction opposite from said belt traveling direction.

18. The apparatus of claim 17 wherein said means for maintaining said tensile stress comprises a fluid conduit disposed transversely across said course, and having a plurality of discharge apertures oriented to direct fluid flow against one face of said belt.

* * * * *